US010889410B2

(12) United States Patent
Maurier

(10) Patent No.: US 10,889,410 B2
(45) Date of Patent: Jan. 12, 2021

(54) MOBILITY ASSEMBLY FOR A CONTAINER

(71) Applicant: Kathryn Heather Maurier, Dearborn, MI (US)

(72) Inventor: Kathryn Heather Maurier, Dearborn, MI (US)

(73) Assignee: Kathryn Heather Maurier, Dearborn, MI (US)

( * ) Notice: Subject to any disclaimer, the term of this patent is extended or adjusted under 35 U.S.C. 154(b) by 53 days.

(21) Appl. No.: 16/260,963

(22) Filed: Jan. 29, 2019

(65) Prior Publication Data

US 2020/0239192 A1 Jul. 30, 2020

(51) Int. Cl.
*B65D 25/20* (2006.01)
*B65D 25/28* (2006.01)
*B65D 8/00* (2006.01)

(52) U.S. Cl.
CPC ..... *B65D 25/2858* (2013.01); *B65D 7/045* (2013.01); *B65D 25/20* (2013.01)

(58) Field of Classification Search
CPC ..... B65D 25/282; B65D 25/2826; B65D 25/2835; B65D 25/00
See application file for complete search history.

(56) References Cited

U.S. PATENT DOCUMENTS

| | | | | |
|---|---|---|---|---|
| 2,181,438 | A | 12/1939 | Peet | |
| 2,917,906 | A | 12/1959 | Woolley | |
| 4,561,239 | A * | 12/1985 | Cook | A01D 34/824 16/437 |
| 8,567,014 | B1 * | 10/2013 | Huang | B25G 1/06 16/405 |
| 2010/0247276 | A1 * | 9/2010 | Loria | B62B 5/0083 414/373 |
| 2018/0188099 | A1 * | 7/2018 | McCoy | B67D 1/00 |

* cited by examiner

*Primary Examiner* — John D Walters
*Assistant Examiner* — James J Triggs
(74) *Attorney, Agent, or Firm* — Cantor Colburn LLP

(57) ABSTRACT

A mobility assembly for a container includes a handle bracket to attach to a first chime of a container, the container has a body that extends between a first wall and a second wall, the first chime has an inner surface and an outer surface each that extend between the first wall and a rim of the first chime, the rim extends between distal ends of the inner and outer surfaces, the first chime that extends from the first wall, and a handle arranged to attach to the handle bracket.

18 Claims, 7 Drawing Sheets

MOBILITY ASSEMBLY FOR A CONTAINER

BACKGROUND

The present disclosure relates to a mobility assembly for a container.

A container, such as a beer keg, may be difficult to handle due to the beer keg's shape and weight. These handling difficulties may make transportation of the beer keg difficult.

BRIEF DESCRIPTION OF THE INVENTION

According to one aspect of the disclosure, a mobility assembly for a container includes a handle bracket to attach to a first chime of a container, the container having a body extending between a first wall and a second wall, the first chime having an inner surface and an outer surface, each of the inner and outer surface extending between the first wall and a rim of the first chime, the rim extends between distal ends of the inner and outer surfaces, the first chime extending from the first wall, and a handle arranged to attach to the handle bracket.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which.

DETAILED DESCRIPTION

Referring now to the Figures, where the present disclosure will be described with reference to specific embodiments, without limiting same, it is to be understood that the disclosed embodiments are merely illustrative of the present disclosure that may be embodied in various and alternative forms. Various elements of the disclosed embodiments may be combined or omitted to form further embodiments of the present disclosure. The Figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present disclosure.

Figure 1:
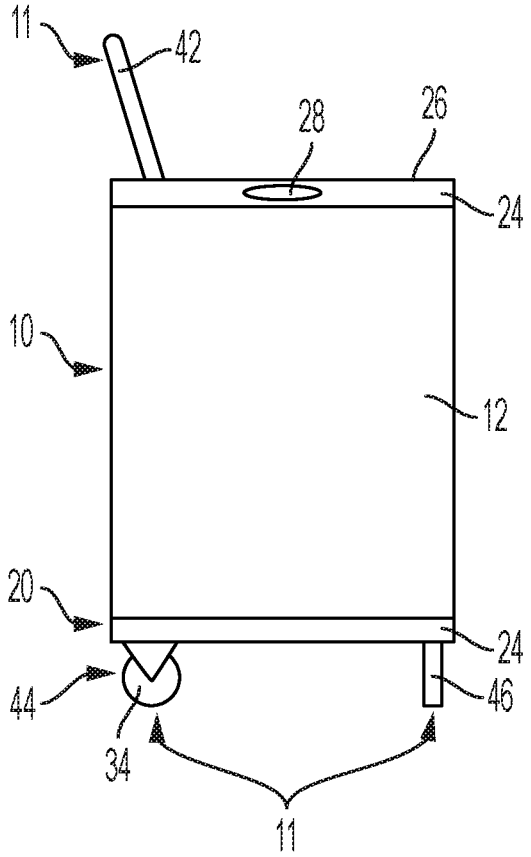
FIG. 1 is a side view of a mobility assembly attached to a container.
Figure 2:
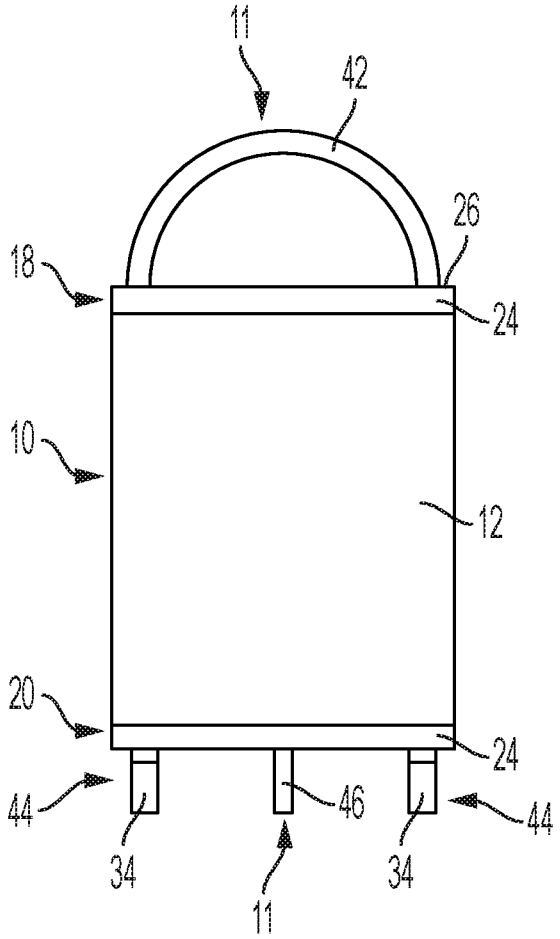
FIG. 2 is a front view of the mobility assembly attached to the container.

Referring to FIGS. 1 and 2, a container 10 having a mobility assembly 11 attached thereto is shown. The container 10 may be a keg or any other type of enclosure made for storing and or transporting a liquid, gas, or solid. The container 10 includes a body 12 extending between a first wall 14 (See FIG. 3) and a second wall 16 (See FIG. 7). The container 10 further includes a first chime 18 and a second chime 20.

The first chime 18 extends away from and is disposed generally perpendicular to the first wall 14. The first chime 18 has an inner surface 22 (See FIG. 3), an outer surface 24, and a rim 26 extending between distal ends of the inner surface 22 and the outer surface 24. The inner surface 22 and the outer surface 24 each extend between the first wall 14 and the rim 26. The first chime 18 protects the first wall 14 and a tap 23 of (See FIGS. 3 and 4) the first wall from damage in storage. The first chime 18 also defines an opening 28 that extends through the inner surface 22 and the outer surface 24. A user may place a portion of their hand through the opening 28 to facilitate lifting of the container 10.

The second chime 20 extends away from and is disposed generally perpendicular to the second wall 16. The second chime 20 has an inner surface 22 and an outer surface 24 just like the first chime 18. The second chime 20 protects the second wall 16 from damage in storage.

The container 10 may be difficult to handle due to its shape and weight. Given a full containers weight and placement of the opening 28, a user usually transports the container 10 by attempting to lift it at an awkward angle or placing the container 10 onto other transportation mechanisms. The mobility assembly 11 facilitates transportation and handling of the container 10 by allowing a person to transfer the weight of the container and its contents onto at least one wheel 34 of a mobility assembly 11 so as to roll rather than carry the container 10 from one place to another.

Referring to FIGS. 3-7 the mobility assembly 11 is permanently attached. The mobility assembly 11 includes a handle bracket 40, a handle 42, the wheel assembly 44, and a leveling member 46.

Figure 3:
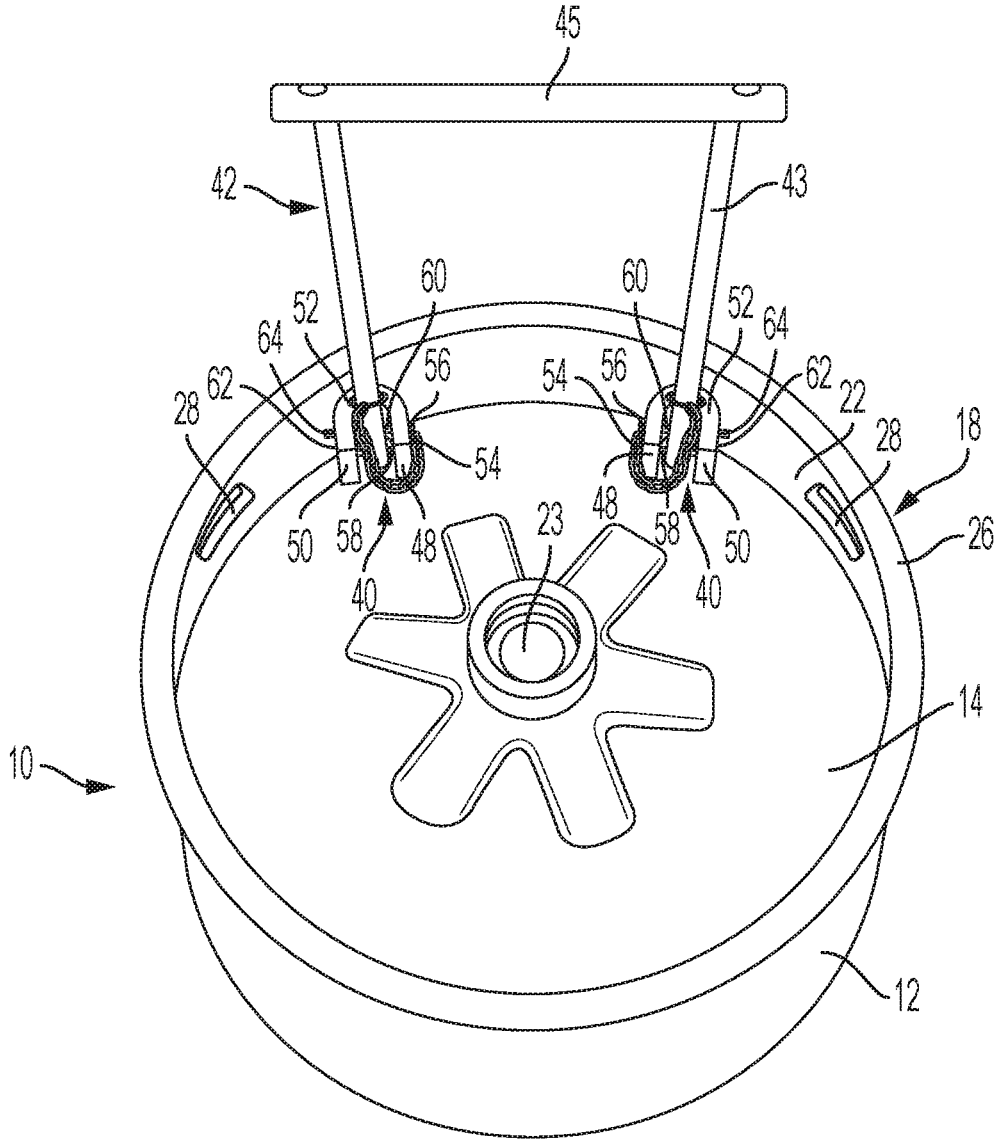
FIG. 3 is a perspective view of a handle of the mobility assembly in an extended position.
Figure 4:
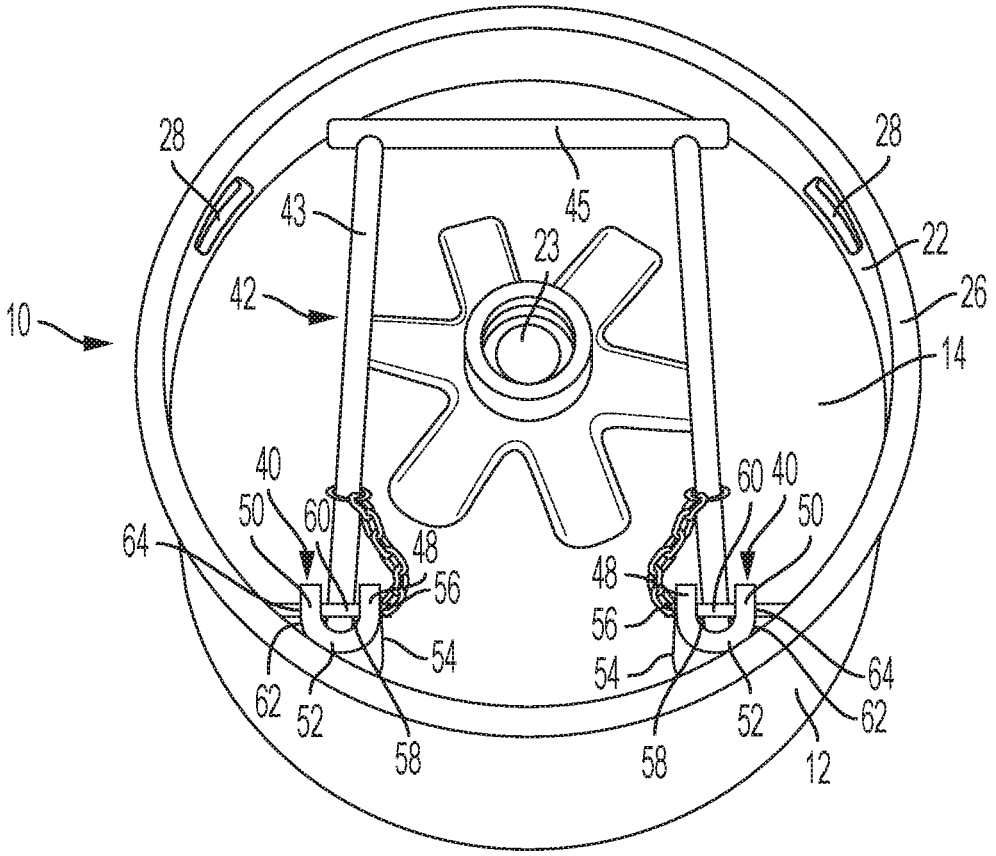
FIG. 4 is a perspective view of the handle of the mobility assembly in a collapsed position.

Referring to FIGS. 3 and 4, the handle bracket 40 is arranged to attach to the inner surface 22 of the first chime 18 of the container 10. The handle bracket 40 includes a first handle bracket portion 48, a second handle bracket portion 50, and a third handle bracket portion 52. The first handle bracket portion 48 is attached to the third handle bracket portion 52 and substantially parallel to the second handle bracket portion 50, and defines a first hole 54 and a second hole 56. The first hole 54 is disposed closer to the first wall 14, relative to a distance between the second hole 56. The second handle bracket portion 50 is spaced apart from and substantially parallel to the first handle bracket portion 48 and is also attached to the third handle bracket portion 52. The second handle bracket portion 50 defines a third hole 62 and a fourth hole 64. Holes 54, 56, 62, and 64 are shown well in FIG. 6. The third hole 62 is disposed closer to the first wall 14 relative to a distance between the fourth hole 64 and the first wall 14. The third handle bracket portion 52 extends between the first handle bracket portion 48 and second handle bracket portion 50, and is arranged to attach to the inner surface 22 of the first chime 18. In some embodiments, the first handle bracket portion 48 and the second handle bracket portion 50 may be directly attached to the inner surface 22 of the first chime 18.

Figure 5:
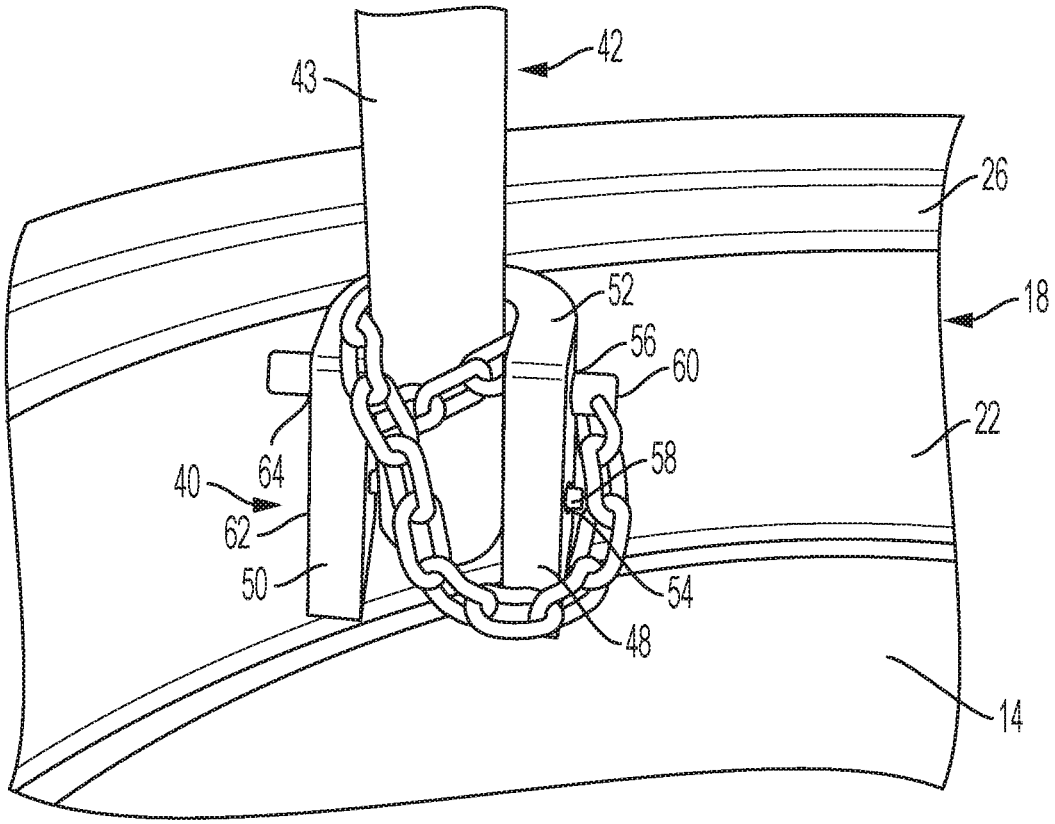
FIG. 5 is a perspective view of a handle bracket of the mobility assembly.
Figure 6:
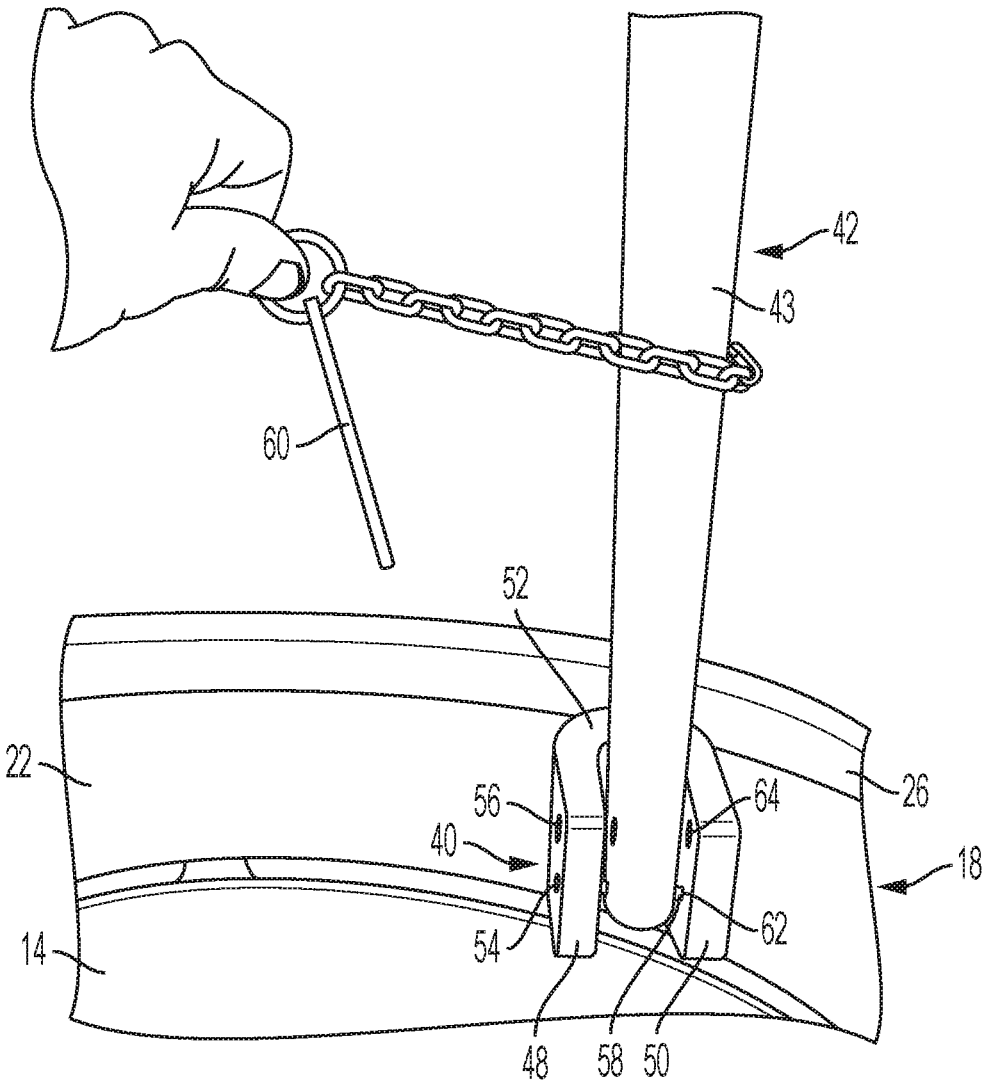
FIG. 6 is a perspective view of the handle bracket of the mobility assembly having a pin removed.

Referring to FIGS. 5 and 6 the handle 42 is arranged to attach to the handle bracket 40. The handle 42 includes a pair of first handle members 43 and a second handle member 45 that connects the first handle members 43. The first handle member 43 is arranged to interface with the handle bracket 40. The first handle member 43 is connected to the handle bracket 40 via a first pin 58 that extends through the first hole 54 of the first bracket portion 48, the third hole 62 of the second bracket portion 50, and the first handle member 43. The handle 42 is movable between an extended position (See FIG. 3) and a stowed (or collapsed) position (See FIG. 4). When in an extended position the handle 42 extends away from the container 10 and toward the user allowing the user to pull on the handle 42 to facilitate transportation of the container 10. When in a stowed position the handle 42 lays flat (or nearly flat) and substantially parallel to the first wall 14 allowing for easy storage of the container 10.

The handle 42 is locked into an extended position when a second pin 60 is inserted into the second hole 56 in the first handle bracket portion 48 and the fourth hole 64 in the second handle bracket portion 50, and the first handle member 43. The handle 42 is locked into a stowed position when the second pin 60 is inserted into the second hole 50 in the first handle bracket portion 48 and the fourth hole 64 in the second handle bracket portion 50, and passing over, rather than through, the first handle member 43.

Figure 7:
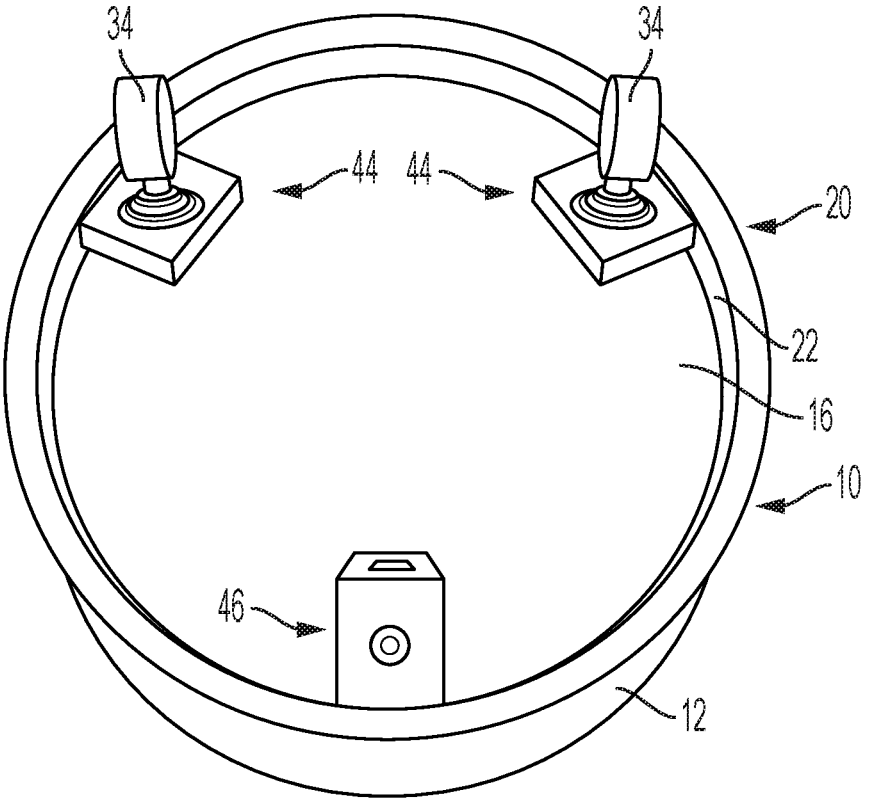
FIG. 7 is a perspective view of wheels and a leveling member of the mobility assembly attached to the container.

Referring to FIG. 7 permanently attached to the inner surface 22 of the second chime 20 is a wheel assembly 44. The second chime 20 has the purpose of protecting the second wall 16 from damage. The wheel assembly 44 may be fixedly secured to the inner surface 22 of the second chime 20 or to the second wall 16 of the container 10. The wheel assembly 44 may be attached in any suitable manner, including via bolts or a welding method. The wheel assembly 44 allows for the container 10 to be transported by tilting the container thereby placing its weight onto the wheel 34 rather than attempting to lift the possibly heavy and awkwardly shaped container 10. The wheel assembly 44 includes the wheel 34 that extends beyond the second chime 20 in a direction away from the second wall 16 towards the second chime 20.

Also shown is the leveling member 46 which allows for the container to be substantially level when stationary. The leveling member 46 keeps the contents of the container 10 in a parallel plane with the first wall 14 of the container 10 when the user is not transporting the container 10. The leveling member 46 achieves its purpose by being perpendicular to and extending away from the second wall 16. The leveling member 46 is spaced apart from the wheel assembly 44 and in some embodiments has a length substantially equal to the diameter of the wheel 34 of the wheel assembly 44. In some embodiments, the leveling member 46 may have an adjustable length or be extensible so it can keep the container 10 level even if the surface beneath the container 10 is not level. The leveling member 46 may be fixedly attached or fixedly secured to the second wall 16 or the inner surface 22 of the second chime 20. In some arrangements, the leveling member 46 may be directly attached to the second wall 16.

Referring to FIGS. 8-11, the mobility assembly 11 may be removably attached to the container 10. This allows a person to attach the mobility assembly 11 when needed for transportation and remove the assembly for storage or shipping purposes. In such an embodiment, the mobility assembly 11 includes a handle assembly 108, a wheel assembly 110, and a leveling member assembly 112.

Figure 8:
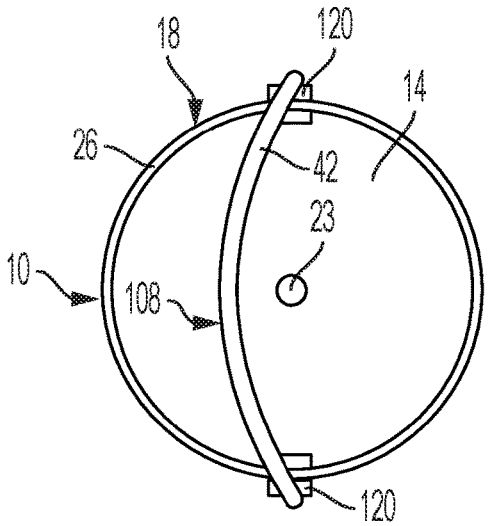
FIG. 8 is a top view of a handle of the mobility assembly attached to a container according to another aspect of the disclosure.
Figure 9:
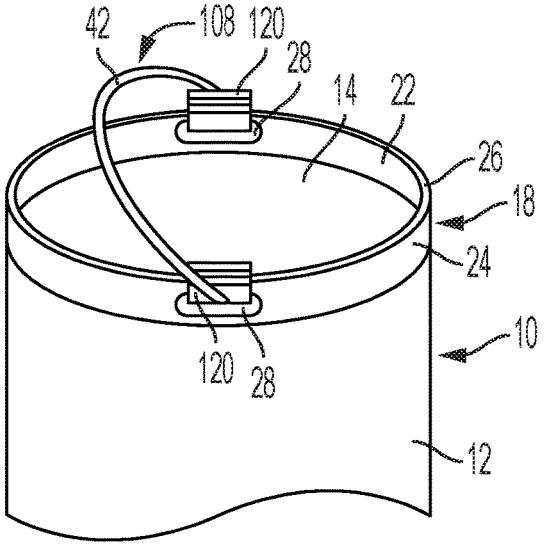
FIG. 9 is a perspective view of the handle of the mobility assembly attached to a chime of the container.

Referring to FIGS. 8 and 9, the handle assembly 108 is shown including the handle 42 and a handle clamp 120. The handle assembly 108 is arranged to attach to the container 10 via the handle clamp 120 that is arranged to extend through the opening 28 of the first chime 18.

Figure 10:
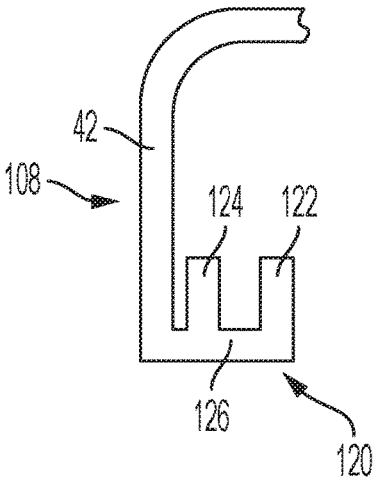
FIG. 10 is a perspective view of a portion of the handle and a handle clamp of the mobility assembly.

Referring to FIG. 10 the handle clamp 120 includes a first handle clamp portion 122, a second handle clamp portion 124, and a third handle clamp portion 126. The first handle clamp portion 122 extends from the third handle clamp portion 126 at a right angle to the third handle clamp portion 126 and substantially parallel to the second handle clamp portion 124. The first handle clamp portion is arranged to engage the inner surface 22 of the first chime 14 to hold the handle assembly 108 in place and inhibit the handle clamp 120 from moving out of the opening 28 of the first chime 18. The second handle clamp portion 124 extends from the third handle clamp portion 126 at a right angle and is substantially parallel to the first handle clamp portion 122. The second handle clamp portion 124 is arranged to engage the outer surface 24 of the first chime 18. The third handle clamp portion 126 extends between the first handle clamp portion 122 and the second handle clamp portion 124. The third handle clamp portion 126 extends through the opening 28 of the first chime 18. The handle clamp 122 maintains the connection between the handle assembly 108 and the container 10 while a person is using it to transportation of the container 10.

Figure 11:
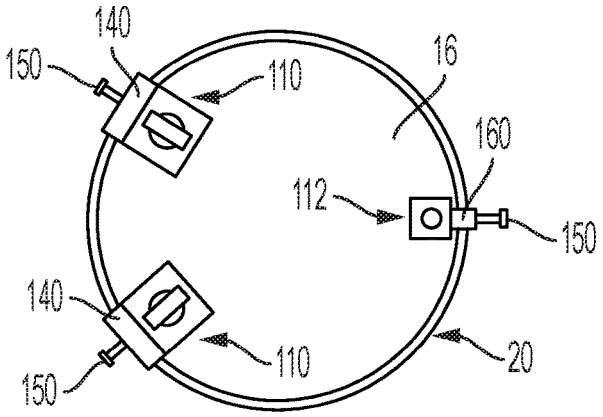
FIG. 11 is a bottom view of wheels and a leveling member of the mobility assembly attached to the container.
Figure 12:
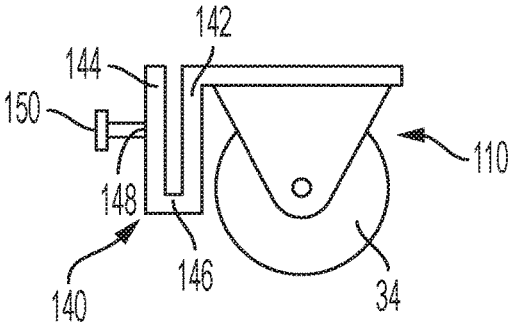
FIG. 12 is a perspective view of a wheel and wheel clamp of the mobility assembly.

Referring to FIGS. 11 and 12, the wheel assembly 110 includes a wheel clamp 140, which allows a user to attach the wheel assembly 110 to the container 11, and a wheel 34. The wheel clamp 140 includes a first wheel clamp portion 142, a second wheel clamp portion 144, and a third wheel clamp portion 146. The first wheel clamp portion 142 is arranged to engage the inner surface 22 of the second chime 16 stabilizing the wheel 34 with the container 10 against any weight that would force the wheel 34 to collapse out or disengage with the second chime 16 of the container 10. The second wheel clamp portion 144 is spaced apart from and parallel to the first wheel clamp portion 142. The second wheel clamp portion 144 is arranged to engage the outer surface 24 of the second chime 16 stabilizing the wheel 34 with the container 10 against any weight that would force the wheel 34 to collapse underneath or disengage with second chime 16 of the container 10. The second wheel clamp portion 144 also has an opening 148 through which a fastener 150 is inserted to engaged the outer surface 24 of the second chime 20 to secure the wheel clamp 140 to the second chime 20. The third wheel clamp portion 146 extends between the first portion 142 and the second portion 144 to connect the two portions together.

Figure 13:
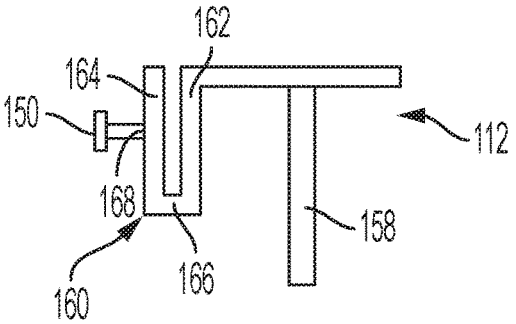
FIG. 13 is a perspective view of a leveling member and leveling member clamp of the mobility assembly.

Referring to FIGS. 11 and 13, the leveling member assembly 112 includes a leveling member 158 and a leveling member clamp 160. The leveling member clamp 160 includes a first leveling member clamp portion 162, a second leveling member clamp portion 164, and a third leveling member clamp portion 166. The first leveling member clamp portion is arranged to engage the inner surface 22 of the second chime 20 stabilizing the leveling member assembly 112 with the container 10 against any weight that would force the leveling member 158 to collapse out or disengage with the second chime 16 of the container 10. The second leveling member clamp portion 164 is spaced apart from and parallel to the first leveling member clamp portion 162. The second leveling member clamp portion 164 is arranged to engage the outer surface 24 of the second chime 20, stabilizing the leveling member 158 with the container 10 against any weight that would force the leveling member assembly 112 to collapse underneath or disengage with second chime 16 of the container 10. The second leveling member clamp portion 164 also has an opening 168 through which a fastener 150 is inserted to engaged the outer surface 24 of the second chime 20 to secure the leveling member clamp 160 to the second chime 20. The third leveling member clamp portion 166 extends between the first portion 162 and the second portion 164 to connect the portions together. The leveling member 158 is parallel to the first leveling member clamp portion 162. When the leveling member assembly 112 is attached to the container 10 the leveling member is arranged to be adjacent to but spaced apart from the inner surface 22 of the second chime 20, and perpendicular to the second wall 16.

The mobility assembly allows the user to easily transport a container 10 without the need to lift or drag the container 10. The mobility assembly 11 allows the user to simply pull on the handle 42 transferring the weight of the container and its contents onto the wheel 34. Once transportation is complete the container may be left standing upright due to the leveling member, or the mobility assembly may be removed.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions or equivalent arrangements not heretofore described, but which are commensurate with the spirit and scope of the present disclosure. Additionally, while various embodiments of the present disclosure have been described, it is to be understood that aspects of the present disclosure may include only some of the described embodiments or combinations of the described embodiments. Accordingly, the present disclosure is not to be seen as limited by the foregoing description.

The invention claimed is:

1. A mobility assembly for a container comprising:

a handle bracket arranged to attach to a first chime of a container having a body extending between a first wall and a second wall, the first chime having an inner surface and an outer surface each extending between the first wall and a rim of the first chime, the rim extending between distal ends of the inner and outer surfaces, the first chime extending from the first wall;

a handle arranged to attach to the handle bracket and a leveling member that extends from the second wall and is spaced apart from the wheel assembly.

2. The mobility assembly of claim 1, the handle having a first member arranged to interface with the handle bracket and a second member extending from the first member and spaced apart from the handle bracket.

3. The mobility assembly of claim 2, the handle bracket comprising:

a first bracket portion, the first bracket portion defining a first hole, a second bracket portion spaced apart from the first bracket portion, the second bracket portion defining a third hole; and and a third bracket portion extending between the first portion and the second portion, the third bracket portion being connected to the inner surface of the first chime.

4. The mobility assembly of claim 3, the first handle member being connected to the first bracket portion and the second bracket portion by a first pin that extends through the first hole of the first bracket portion, the third hole of the second bracket portion, and the first handle member.

5. The mobility assembly of claim 2, the handle being movable between an extended position in which the first member is disposed in a non-parallel relationship with the first wall and a stowed position which the first member is disposed in a parallel relationship with the first wall.

6. The mobility assembly of claim 3, the first bracket portion defines a second hole spaced apart from the first hole and the second bracket portion defines a fourth hole spaced apart from the third hole, the second hole being aligned with the fourth hole.

7. The mobility assembly of claim 6, the first handle member having a second pin that extends through the second hole of the first bracket portion and the fourth hole of the second bracket portion, to lock handle in the extended or stowed position.

8. The mobility assembly of claim 7, the second pin is arranged to be inserted through the second hole and the fourth hole to inhibit the handle from moving away from the stowed position, while the handle is in the stowed position.

9. The mobility assembly of claim 7, the first pin is arranged to be inserted through the first hole and third hole of the handle bracket and the second pin is arranged to be inserted through the second hole and the fourth hole of the handle bracket to inhibit the handle moving away from the extended position.

10. The mobility assembly of claim 1, further comprising:

a wheel assembly arranged to attach to at least one of the second wall or a second chime extending from the second wall.

11. The mobility assembly of claim 10, the wheel assembly having a wheel that extends beyond the second chime in a direction that extends from the second wall towards the second chime.

12. The mobility assembly of claim 1, the member having a length substantially equal to a diameter of the wheel.

13. A mobility assembly for a container comprising:

a handle arranged to extend at least partially through an opening of a first chime of a container the first chime having an inner surface and an outer surface each extending between the first wall and a rim of the first chime, the rim extends between distal ends of the inner and outer surfaces, the first chime extending from the first wall, the opening extending through the inner surface and outer surface of the first chime, the handle having a first handle portion arranged to engage the inner surface of the first chime and a second handle portion extending from the first handle portion, the handle further comprising a handle clamp, the clamp having a first handle clamp portion that is arranged to engage the inner surface of the first chime, a second handle clamp portion arranged to engage the outer surface of the first chime, and a third handle clamp portion extending through the opening of the first chime.

14. The mobility assembly of claim 13 further comprising a wheel assembly arranged to attach to a second chime extending from a second wall of the container.

15. The mobility assembly of claim 14, the wheel assembly further comprising a wheel clamp, the clamp having a first wheel clamp portion that is arranged to engage the inner surface of the second chime, a second wheel clamp portion arranged to engage the outer surface of the second chime, and a third wheel clamp portion extending between the first portion and the second portion, the second wheel clamp portion having an opening through which a fastener is inserted to engaged the outer surface of the second chime.

16. The mobility assembly of claim 13 further comprising a leveling member arranged to attach to the second chime, the leveling member having a leveling member clamp, the clamp having a first leveling member clamp portion that is arranged to engage the inner surface of the second chime, a second leveling member clamp portion arranged to engage the outer surface of the second chime, and a third leveling member clamp portion extending between the first portion and the second portion, the second leveling member clamp portion having an opening through which a fastener is inserted to engaged the outer surface of the second chime.

17. The mobility assembly of claim 16, the leveling member arranged to contact a surface in order to level or stop the container from moving when in a stationary position, the member being a length equal to the length diameter of the wheel of the wheel assembly.

18. A mobility assembly for a keg comprising:

a handle arranged to attach to a handle bracket;

the handle bracket arranged to attach to a first chime of a keg having a body extending between a first wall and a second wall, the first chime having an inner surface and an outer surface each extending between the first wall and a rim of the first chime, the rim extending between distal ends of the inner and outer surfaces, the first chime extending from the first wall;

a wheel assembly arranged to attach to at least one of the second wall or a second chime extending from the second wall; and a leveling member that extends from the second wall and is spaced apart from the wheel assembly.

* * * * *